US006060231A

United States Patent [19]

Zou

[11] Patent Number: 6,060,231

[45] **Date of Patent: *May 9, 2000**

[54] PHOTOTHERMOGRAPHIC ELEMENT WITH IRIDIUM AND COPPER DOPED SILVER HALIDE GRAINS

[75] Inventor: Chaofeng Zou, Maplewood, Minn.

[73] Assignee: Eastman Kodak Company, Rochester, N.Y.

[ * ] Notice: This patent is subject to a terminal disclaimer.

[21] Appl. No.: 09/273,897

[22] Filed: Mar. 22, 1999

Related U.S. Application Data

[63] Continuation of application No. 08/881,407, Jun. 24, 1997, Pat. No. 5,939,249.

[51] Int. Cl.[7] ..... G03C 1/498

[52] U.S. Cl. ..... 430/619; 430/567; 430/604; 430/605

[58] Field of Search ..... 430/619, 569, 430/604, 605, 567

[56] References Cited

U.S. PATENT DOCUMENTS

| | | |
|---|---|---|
| 1,623,499 | 4/1927 | Sheppard et al. . |
| 2,131,038 | 9/1938 | Brooker et al. . |
| 2,399,083 | 4/1946 | Waller et al. . |
| 2,444,605 | 12/1948 | Heimbach et al. . |
| 2,489,341 | 11/1949 | Waller et al. . |
| 2,565,418 | 8/1951 | Yackel . |
| 2,566,263 | 8/1951 | Trivelli et al. . |
| 2,588,765 | 3/1952 | Robijns et al. . |
| 2,614,928 | 10/1952 | Yutzy et al. . |
| 2,618,556 | 11/1952 | Hewitson et al. . |
| 2,681,294 | 6/1954 | Beguin . |
| 2,694,716 | 11/1954 | Allen et al. . |
| 2,701,245 | 2/1955 | Lynn . |
| 2,728,663 | 12/1955 | Allen et al. . |
| 2,761,791 | 9/1956 | Russell . |
| 2,839,405 | 6/1958 | Jones . |
| 2,861,056 | 11/1958 | Minsk . |
| 2,886,437 | 5/1959 | Piper . |
| 2,960,404 | 11/1960 | Milton et al. . |
| 2,992,101 | 7/1961 | Jelley et al. . |
| 3,080,254 | 3/1963 | Grant, Jr. . |
| 3,121,060 | 2/1964 | Duane . |
| 3,201,678 | 8/1965 | Meixell . |
| 3,206,312 | 9/1965 | Sterman et al. . |
| 3,220,839 | 11/1965 | Herz et al. . |
| 3,235,652 | 2/1966 | Lindsey . |
| 3,241,969 | 3/1966 | Hart . |
| 3,287,135 | 11/1966 | Hart . |
| 3,297,446 | 1/1967 | Dunn . |
| 3,297,447 | 1/1967 | McVeigh . |
| 3,330,663 | 7/1967 | Weyde et al. . |
| 3,415,650 | 12/1968 | Frame et al. . |
| 3,428,451 | 2/1969 | Trevoy . |
| 3,457,075 | 7/1969 | Morgan et al. . |
| 3,589,903 | 6/1971 | Birkeland . |
| 3,782,954 | 1/1974 | Porter et al. . |
| 3,785,830 | 1/1974 | Sullivan et al. . |
| 3,821,002 | 6/1974 | Culhane et al. . |
| 3,839,049 | 10/1974 | Simons . |
| 3,847,612 | 11/1974 | Winslow . |
| 3,985,565 | 10/1976 | Gabrielsen et al. . |
| 4,123,274 | 10/1978 | Knight et al. . |
| 4,123,282 | 10/1978 | Winslow . |
| 4,152,160 | 5/1979 | Ikienoue et al. . |
| 4,161,408 | 7/1979 | Winslow et al. . |
| 4,212,937 | 7/1980 | Akashi et al. . |
| 4,220,709 | 9/1980 | deMauriac . |
| 4,260,677 | 4/1981 | Winslow . |
| 4,374,921 | 2/1983 | Frenchik . |
| 4,761,361 | 8/1988 | Ozaki et al. . |
| 4,775,613 | 10/1988 | Hirai et al. . |
| 4,784,939 | 11/1988 | Van Pham . |
| 5,028,523 | 7/1991 | Skoug . |
| 5,051,344 | 9/1991 | Kuno . |

(List continued on next page.)

FOREIGN PATENT DOCUMENTS

| | | |
|---|---|---|
| 0559228 | 9/1993 | European Pat. Off. . |
| 0600589 | 6/1994 | European Pat. Off. . |
| 0627660 | 12/1994 | European Pat. Off. . |
| 0743554 | 11/1996 | European Pat. Off. . |
| 52-126780 | 10/1977 | Japan . |
| 54-48521 | 4/1979 | Japan . |
| 61-129642 | 6/1986 | Japan . |
| 63-300234 | 12/1988 | Japan . |
| 623448 | 5/1949 | United Kingdom . |
| 837095 | 6/1960 | United Kingdom . |
| 955061 | 4/1964 | United Kingdom . |
| 2063499 | 6/1981 | United Kingdom . |

OTHER PUBLICATIONS

Klosterboer, "Thermally Processed Silver Systems," *Imaging Processes and Materials, Neblette's Eigth Edition*, Chapter 9, pp. 279–291.

Brinckman et al., "Unconventional Imaging Processes," *The Focal Press*, 1978, pp. 74–78.

Zou et al., "Mechanisms of Latent Image Formation in Photothermographic Silver Imaging Media," *Journal of Imaging Science and Technology*, vol. 40, No. 2, Mar./Apr. 1996, pp. 94–103.

T.H. James, "The Mechanism of Development,"Chapter 13 of *The Theory of the Photographic Process*, Fourth Ed., Eastman Kodak Company, Rochester, NY, 373–374 (1977).

T.H. James, *The Theory of the Photographic Process*, 3rd Edition, Chapter 2, pp. 198–232, Macmillan (1966).

T.H. James, *The Theory of the Photographic Process*, 4th Edition, Chapter 5, pp. 149–169, Macmillan (1977).

(List continued on next page.)

*Primary Examiner*—Thorl Chea
*Attorney, Agent, or Firm*—J. Lanny Tucker

[57] ABSTRACT

A negative-acting photothermographic element comprises a support bearing at least one heat-developable, photosensitive, image-forming photothermographic emulsion layer that contains photosensitive silver halide grains doped with iridium and copper; a non-photosensitive, reducible source of silver; a reducing agent for the non-photosensitive, reducible source of silver; and a binder. A process of forming photothermographic emulsions from doped silver halide grains by forming silver soaps in the presence of those grains is also described.

27 Claims, No Drawings

U.S. PATENT DOCUMENTS

| | | | |
|---|---|---|---|
| 5,064,753 | 11/1991 | Sohei et al. . | |
| 5,135,842 | 8/1992 | Kitchin et al. . | |
| 5,158,866 | 10/1992 | Simpson et al. . | |
| 5,175,081 | 12/1992 | Krepski et al. . | |
| 5,226,452 | 7/1993 | Muller et al. . | |
| 5,262,295 | 11/1993 | Tanaka et al. . | |
| 5,279,928 | 1/1994 | Dedio et al. . | |
| 5,298,390 | 3/1994 | Sakizadeh et al. . | |
| 5,300,420 | 4/1994 | Kenney et al. . | |
| 5,310,640 | 5/1994 | Markin et al. . | |
| 5,314,795 | 5/1994 | Helland et al. . | |
| 5,340,613 | 8/1994 | Hanzalik et al. . | |
| 5,380,635 | 1/1995 | Gomez et al. . | |
| 5,434,043 | 7/1995 | Zou et al. | 430/619 |
| 5,441,866 | 8/1995 | Miller et al. . | |
| 5,460,938 | 10/1995 | Kirk et al. . | |
| 5,491,059 | 2/1996 | Whitcomb . | |
| 5,496,695 | 3/1996 | Simpson et al. . | |
| 5,541,054 | 7/1996 | Miller et al. . | |
| 5,545,505 | 8/1996 | Simpson . | |
| 5,545,507 | 8/1996 | Simpson . | |
| 5,545,515 | 8/1996 | Murray et al. . | |
| 5,558,983 | 9/1996 | Simpson et al. . | |
| 5,610,006 | 3/1997 | Yokoawa et al. | 430/604 |
| 5,627,020 | 5/1997 | Hahm et al. | 430/569 |
| 5,634,339 | 6/1997 | Lewis et al. . | |
| 5,637,449 | 6/1997 | Harring et al. . | |
| 5,654,130 | 8/1997 | Murray . | |
| 5,705,324 | 1/1998 | Murray . | |
| 5,776,820 | 6/1998 | Fukawa et al. | 430/264 |

OTHER PUBLICATIONS

"Photothermographic Silver Halide Material and Process," Item 22812 in *Research Disclosure*, pp. 155–156 (Apr. 1983).

"Carbamoyloxy Substituted Couplers in a Photothermographic Element and Process," Item 23419 in *Research Disclosure*, pp. 314–315 (Oct. 1983).

V.L. Zelikman et al., *Making and Coating Photographic Emulsions*, The Focal Press, 1964.

"Particle Size Analysis," ASTM Symposium on Light Microscopy, R.P. Loveland, 1955, pp. 94–122.

Harbison et al., "Chemical Sensitization and Environmental Effects," *The Theory of the Photographic Process*, Fourth Edition Chapter 5, pp. 149–169.

PHOTOTHERMOGRAPHIC ELEMENT WITH IRIDIUM AND COPPER DOPED SILVER HALIDE GRAINS

This is a continuation of application Ser. No. 08/881,407, filed Jun. 24, 1997, U.S. Pat. No. 5,939,249, which is incorporated herein by reference.

FIELD OF THE INVENTION

This invention relates to a photothermographic element containing pre-formed silver halide grains doped with iridium and copper. The element has excellent storage stability and sensitometry characteristics.

BACKGROUND OF THE INVENTION

Silver halide-containing photothermographic imaging materials (i.e., heat-developable photographic elements) processed with heat, and without liquid development, have been known in the art for many years. These materials are also known as "dry silver" compositions or emulsions and generally comprise a support having coated thereon: (a) a photosensitive compound that generates silver atoms when irradiated; (b) a relatively or completely non-photosensitive, reducible silver source; (c) a reducing agent (i.e., a developer) for silver ion, for example the silver ion in the non-photosensitive, reducible silver source; and (d) a binder.

In photothermographic emulsions, the photosensitive compound is generally photosensitive silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source within a catalytic sphere of influence around the silver specs. It has long been understood that silver atoms (Ag°) are a catalyst for the reduction of silver ions, and that the photosensitive silver halide can be placed into catalytic proximity with the non-photosensitive, reducible silver source in a number of different fashions. The silver halide may be made "in situ," for example by adding a halogen-containing source to the reducible silver source to achieve partial metathesis (see, for example, U.S. Pat. No. 3,457,075); or by coprecipitation of silver halide and the reducible silver source (see, for example, U.S. Pat. No. 3,839,049). The silver halide may also be pre-formed (i.e., made "ex situ") and added to the organic silver salt. The addition of silver halide grains to photothermographic materials is described in *Research Disclosure,* June 1978, Item No. 17029. The reducible silver source may also be generated in the presence of these ex situ, pre-formed silver halide grains. It is reported in the art that when silver halide is made ex situ, one has the possibility of controlling the composition and size of the grains much more precisely, so that one can impart more specific properties to the photothermographic element and can do so much more consistently than with the in situ technique.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image is generally not visible by ordinary means. Thus, the photosensitive emulsion must be further developed to produce a visible image. This is accomplished by the reduction of silver ions which are in catalytic proximity to silver halide grains bearing the clusters of silver atoms (i.e., the latent image). This produces a black-and-white image. In photographic elements, the silver halide is reduced to form the black-and-white image. In photothermographic elements, the light-insensitive silver source is reduced to form the visible black-and-white image while much of the silver halide remains as silver halide and is not reduced.

In photothermographic elements the reducing agent for the organic silver salt, often referred to as a "developer," may be any material, preferably any organic material, that can reduce silver ion to metallic silver and is preferably of relatively low activity until it is heated to a temperature above about 80° C. At elevated temperatures, in the presence of the latent image, the silver ion of the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted-hydroquinones, catechol, pyrogallol, ascorbic acid, and ascorbic acid derivatives are useful, they tend to result in very reactive photothermographic formulations and cause fog during preparation and coating of photothermographic elements. As a result, hindered phenol reducing agents have traditionally been preferred.

With the increased commercial availability of low-irradiance light sources such as light emitting diodes (LED), cathode ray tubes (CRT), and particularly semi-conductor laser diodes, as sources for output of electronically stored image data onto photosensitive films or paper, have come efforts to produce more highly sensitive photothermographic elements to match such exposure sources both in wavelength and sensitivity to light intensity. Such articles find particular utility in laser scanners.

Differences Between Photothermography and Photography

The imaging arts have long recognized that the field of photothermography is clearly distinct from that of photography. Photothermographic elements differ significantly from conventional silver halide photographic elements which require wet-processing.

In photothermographic imaging elements, a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the physical development of the non-photosensitive, reducible silver source. In contrast, conventional wet-processed black-and-white photographic elements use only one form of silver (e.g., silver halide): upon chemical development, the silver halide is itself converted to the silver image or upon physical development requires addition of an external silver source.

Additionally, photothermographic elements require an amount of silver halide per unit area that is as little as one-hundredth of that used in conventional wet-processed silver halide.

Photothermographic systems employ a light-insensitive silver salt, such as silver behenate, which participates with the developer in developing the latent image. Chemically developed photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic elements, all of the "chemistry" of the system is incorporated within the element itself. For example, photothermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions. Even in so-called instant photography, the developer chemistry is physically separated from the photosensitive silver halide until development is desired. Much effort has gone into the preparation and manufacture of photothermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic elements the binder is capable of wide variation and a number of binders are useful in preparing these elements. In contrast, photographic elements are limited almost exclusively to hydrophilic colloidal binders such as gelatin.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic element or incorporated in a photographic element.

Because of these and other differences, additives which have one effect in conventional silver halide photography may behave quite differently in photothermographic elements where the underlying chemistry is so much more complex. For example, it is not uncommon for an antifoggant for a silver halide system to produce various types of fog when incorporated into photothermographic elements.

Distinctions between photothermographic and photographic elements are described in *Imaging Processes and Materials* (*Neblette's Eighth Edition*); J. Sturge et al. Ed; Van Nostrand Reinhold: New York, 1989, Chapter 9; in *Unconventional Imaging Processes;* E. Brinckman et al, Ed; The Focal Press: London and New York: 1978, pp. 74–75; and in C-f Zou, M. R. V Shayun, B. Levy, and N Serpone *J. Imaging Sci. Technol.* 1996, 40, 94–103.

In efforts to make more sensitive photothermographic materials, one of the most difficult parameters to maintain at a very low level is the various types of fog or $D_{min}$. Fog is spurious image density which appears in non-imaged areas of the element after development and is often reported in sensitometric results as $D_{min}$.

Without the ability to maintain speed, contrast, and resistance to fog, a commercially useful material is difficult to prepare. Various techniques have been employed to improve sensitivity and maintain resistance to fog.

U.S. Pat. No. 3,839,049 discloses a method of associating pre-formed silver halide grains with an organic silver salt dispersion. U.S. Pat. No. 4,161,408 (Winslow et al.) discloses a method of associating a silver halide emulsion with a silver soap by forming the silver soap in the presence of the silver halide emulsion. No sensitometric benefits for the process of this patent as compared to U.S. Pat. No. 3,839,049 are asserted. The process of U.S. Pat. No. 4,161,408 comprises adding silver halide grains with agitation to a dispersion of a long-chain fatty acid in water, with no alkali or metal salt of said fatty acid present while the acid is maintained above its melting point, then converting the acid to its ammonium or alkali metal salt, cooling the dispersion, and then converting the ammonium or alkali metal salt to a silver salt of the acid.

U.S. Pat. No. 4,212,937 describes the use of a nitrogen-containing organic base in combination with a halogen molecule or an organic haloamide to improve storage stability and sensitivity.

Japanese Patent Kokai 61-129 642, published Jun. 17, 1986, describes the use of halogenated compounds to reduce fog in color-forming photothermographic emulsions. These compounds include acetophenones such as phenyl-($\alpha$,$\alpha$-dibromobenzyl)ketone.

U.S. Pat. No. 4,152,160 describes the use of carboxylic acids, such as benzoic acids and phthalic acids, in photothermographic elements. These acids are used as antifoggants.

U.S. Pat. No. 3,589,903 describes the use of small amounts of mercuric ion in photothermographic silver halide emulsions to improve speed and aging stability.

U.S. Pat. No. 4,784,939 describes the use of benzoic acid compounds of a defined formula to reduce fog and to improve the storage stability of silver halide photothermographic emulsions. The addition of halogen molecules to the emulsions are also described as improving fog and stability.

U.S. Pat. No. 5,064,753 discloses a thermally-developable, photographic material containing core-shell silver halide grains that contain a total of 4 to 40 mole % of silver iodide and which have a lower silver iodide content in the shell than in the core. Incorporating silver iodide into the silver halide crystal in amounts greater than 4 mole % is reported to result in increased photosensitivity and reduced $D_{min}$. The silver halide itself is the primary component reduced to silver metal during development.

Japan Patent Kokai 63-300,234 discloses a heat-developable, photosensitive material containing a photosensitive silver halide, a reducing agent, and a binder. The photosensitive silver halide has a silver iodide content of 0.1~40 mole % and a core/shell grain structure. The photosensitive silver halide grains are further sensitized with gold. The material is reported to afford constructions with good sensitivity and low fog.

U.S. Pat. No. 5,434,043 discloses iridium doped pre-formed AgX grains to improve sensitivity and image quality of dry silver type photothermographic material.

The use of transition metal dopants to sensitize the silver halide emulsion and to reduce high-intensity reciprocity failure is known in conventional wet silver halide chemistry, particularly the use of group VIII transition metal ions. U.S. Pat. No. 5,051,344 and EP 743,554 both disclose photographic materials that contain iridium and iron as doping agents. The materials are described as having good speed and contrast properties.

As a photothermographic material is stored, or "ages", a number of difficulties can arise. As noted above, in contrast to conventional silver halide (AgX) chemistry, photothermographic materials contain all of the chemicals necessary for image development. During storage at ambient temperature and environmental humidity, slow chemical reactions between AgX/silver soap and surrounding developers/toners can occur which result in a gradual deterioration of sensitometry, such as fog formation in non-imaging areas and shifting of speed and contrast.

In addition to fog formation, photothermographic imaging materials also tend to slowly change speed and contrast upon shelf aging at ambient temperature and humidity. At elevated temperature and high humidity this process of deteriorating sensitometric properties is accelerated. Although stabilizers typically used in photothermographic material are effective to prevent fog formation, they are less effective in preventing speed and contrast changes, since this type of instability is usually associated with changes in the electronic and ionic properties of AgX micro-crystals during shelf storage. This typically represents only a small percentage of the total silver in the construction.

There is a need for a photothermographic emulsion that can be used to prepare photothermographic materials that can maintain speed and contrast properties, and resist fog, under shelf storage conditions.

SUMMARY OF THE INVENTION

I have discovered that pre-formed silver halide grains doped with iridium and copper provide outstanding shelf stability when used as part of a pre-formed dry silver soap formulation.

These negative-acting, heat-developable photothermographic elements comprise a support bearing at least one photosensitive, image-forming, photothermographic emulsion layer wherein the emulsion layer comprises:

(a) pre-formed photosensitive silver halide grains that are doped with a first doping agent comprising iridium and a second doping agent comprising copper or iron;

(b) a non-photosensitive, reducible source of silver;

(c) a reducing agent for the non-photosensitive, reducible source of silver; and (d) a binder.

A process for forming photothermographic emulsions and elements with iridium and copper doped pre-formed silver halide grains, particularly with formation of a silver soap in the presence of the pre-formed grains is also disclosed, comprising the steps of providing a doped silver halide emulsion, placing said emulsion in the presence of an organic acid or a non-silver salt of an organic acid, and converting said non-silver salt or organic acid to a silver salt in the presence of said doped silver halide emulsion.

The photothermographic elements of this invention can be used, for example, in conventional black-and-white photothermography; in electronically generated black-and-white hardcopy recording; in the graphic arts area for phototypesetting, high contrast photomasks, and in digital proofing; in nondestructive testing; in aerial surveillance and remote sensing; and in the medical arts area for x-ray imaging, medical diagnostic laser imaging, and digital radiographic imaging. In addition to providing good shelf stability, the photothermographic elements of this invention provide high photospeed; with stable, strongly absorbing, high density, black-and-white images of high resolution and good sharpness; and provide a dry and rapid process.

When the photothermographic elements of this invention are imagewise exposed and then heat developed, preferably at a temperature of from about 80° C. to about 250° C. (176° F. to 482° F.) for a duration of from about 1 second to about 2 minutes, in a substantially water-free condition, a black-and-white silver image is obtained.

Heating in a substantially water-free condition as used herein, means heating at a temperature of 80° to 250° C. with little more than ambient water vapor present. The term "substantially water-free condition" means that the reaction system is approximately in equilibrium with water in the air, and water for inducing or promoting the reaction is not particularly or positively supplied from the exterior to the element. Such a condition is described in T. H. James, *The Theory of the Photographic Process,* Fourth Edition, Macmillan 1977, page 374.

As used herein:

The terms "doped silver halide grain" or "doped silver halide emulsion" are used to refer to silver halide grains that are doped with iridium and copper and emulsions that contain such grains.

"Photothermographic element" means a construction comprising at least one photothermographic emulsion layer or a two trip photothermographic set of layers (the "two-trip coating where the silver halide and the reducible silver source are in one layer and the other essential components or desirable additives are distributed as desired in an adjacent coating layer) and any supports, topcoat layers, blocking layers, antihalation layers, subbing or priming layers, etc.

"Emulsion layer" means a layer of a photothermographic element that contains the non-photosensitive, reducible silver source and the photosensitive silver halide;

"Ultraviolet region of the spectrum" means that region of the spectrum less than or equal to about 400 nm, preferably from about 100 nm to about 400 nm (sometimes marginally inclusive up to 405 or 410 nm, although these ranges are often visible to the naked human eye), preferably from about 100 nm to about 400 nm. More preferably, the ultraviolet region of the spectrum is the region between about 190 nm and about 400 nm;

"Short wavelength visible region of the spectrum" means that region of the spectrum from about 400 nm to about 450 nm;

"Visible region of the spectrum" means from about 400 nm to about 750 nm.

"Red region of the spectrum" means from about 600 nm to about 750 nm, about 630 nm to about 700 nm.

"Infrared region of the spectrum" means from about 750 nm to about 1400 nm, preferably from about 750 nm to about 1000 nm.

Other aspects, advantages, and benefits of the present invention are apparent from the detailed description, examples, and claims.

DETAILED DESCRIPTION OF THE INVENTION

The photothermographic elements and materials of the invention contain silver halide grains that have been doped with iridium and copper. This combination of doping agents provides the emulsions and elements of the invention with surprisingly good shelf stability.

The Photosensitive Preformed Doped Silver Halide

There is no particular limitation on the types of silver halides other than the iridium and copper doping of the silver halide in the photosensitive silver halide grains. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the light-insensitive reducible silver compound which serves as a source of reducible silver.

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio.

It is convenient to copper dope the iridium doped silver halide grains disclosed in European Laid Open Patent Application No 0 627 660. It is particularly convenient to copper dope the iridium doped core-shell silver halide grains disclosed and U.S. Pat. No. 5,434,043.

The preferred photosensitive, pre-formed, iridium and copper doped silver halide grains used in the present invention are characterized by their doped core-shell structure wherein the surface layer, known as the "shell" has a lower silver iodide content than the internal phase or bulk, known as the "core". If the silver iodide content in the surface layer of the doped core-shell silver halide grains is higher than or equal to that in the internal phase, disadvantages such as increased $D_{min}$ and increased fog upon storage or shelf aging may occur.

The doped silver halide grains can be doped core-shell (sometimes referred to as "layered") silver halide grains where the core contains 4 to 14 mole % silver iodide and the shell contains a lesser amount of, or no silver iodide with the requirement that the total silver iodide contained in the silver halide grains is less than 4 mole %. Preferably, the core comprises up to 50 mole % of the total silver iodide content in the silver halide grains.

While it suffices for the doped core-shell photosensitive silver halide grains used in the present invention to have a lower silver iodide content in the surface layer (shell) than in the internal phase (core), the silver iodide content of the shell is preferably at least about 2 to 12 mole % lower than the silver iodide content of the core. The shell may be made of silver chloride, silver bromide, silver chlorobromide, silver chloroiodide, or silver bromoiodide.

An emulsion of the preferred doped core-shell silver halide grains used in the present invention may be prepared by first making cores from monodispersed photosensitive silver halide grains, then coating a shell over each of the cores. Monodispersed silver halide grains with desired sizes that serve as cores can be formed by using a "double-jet" method with the pAg being held at a constant level. In the double-jet method, the silver halide is formed by simultaneous addition of a silver source (such as silver nitrate) and a halide source (such as potassium chloride, bromide, iodide, or mixtures thereof) such that the concentration of silver ions (i.e., the pAg) is held at a constant level.

A silver halide emulsion comprising photosensitive silver halide grains to serve as cores for the doped core-shell emulsion may be prepared by employing the method described in various references such as: P. Glafkides, *Chimie et Physique Photographique,* Paul Montel, 1967; G. F. Duffin, *Photographic Emulsion Chemistry,* The Focal Press, 1966; and V. L. Zelikman et al., *Making and Coating Photographic Emulsions,* The Focal Press, 1964. A silver halide emulsion containing highly monodispersed grains to serve as cores for the doped core-shell emulsion may be prepared as described in Japanese Patent Application No. 48 521/79. A shell is then allowed to grow continuously on each of the thus prepared monodispersed core grains in accordance with the method employed in making the monodispersed emulsion. As a result, a silver halide emulsion comprising the monodispersed doped core-shell silver halide grains suitable for use in the present invention is attained.

The term "monodispersed silver halide emulsion" as used in the present invention means an emulsion wherein the silver halide grains present have a size distribution such that the size variance with respect to the average particle size is not greater than the level specified below. An emulsion made of a photosensitive silver halide that consists of silver halide grains that are uniform in shape and which have small variance in grain size (a "monodispersed emulsion") has a virtually normal size distribution and allows its standard deviation to be readily calculated. If the spread of size distribution (%) is defined by (standard deviation/average grain size)×100, then the monodispersed photosensitive silver halide grains used in the present invention preferably have a spread of distribution of less than 15% and, more preferably, less than 10%.

In the photothermographic elements of the present invention the mean average grain size is typically less than 0.10 micrometers, preferably less than 0.09 micrometers, more preferably less than 0.075 micrometers, and most preferably less than 0.06 micrometers. Those of ordinary skill in the art understand that there is a finite lower practical limit for silver halide grains that is partially dependent upon the wavelengths to which the grains are spectrally sensitized, such lower limit, for example being about 0.01 or 0.005 micrometers.

The average size of the photosensitive doped silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "*Particle Size Analysis,*" ASTM Symposium on Light Microscopy, R. P. Loveland, 1955, pp. 94–122; and in *The Theory of the Photographic Process,* C. E. Kenneth Mees and T. H. James, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

The shape of the photosensitive doped silver halide grains of the present invention is in no way limited. The silver halide grains may have any crystalline habit including, but not limited to, cubic, octahedral, tetrahedral, orthorhombic, tabular, laminar, twinned, platelet, etc. If desired, a mixture of these crystals may be employed.

The metal dopants may be added at any time during formation of the silver halide grains. They may be present throughout the grain formation process or added at various stages of the grain formation process. Preferably at least some dopant is present in the outer one-half of the "radius" of the grain.

The iridium compounds used to provide the iridium dopant for the present invention may be water-soluble iridium compounds. Examples of such water-soluble iridium compounds include halogenated iridium (III) compounds, halogenated iridium (IV) compounds, and iridium complex salts containing as ligands halogen, amines, oxalate, etc. Such salts include hexachloroiridium (III) and (IV) complex salts, hexamineiridium (III) and (IV) complex salts, and trioxalateiridium (III) and (IV) complex salts. Any combination of these trivalent and/or tetravalent compounds can be used. The iridium compounds may be used in the form of a solution in water or any other suitable solvent. In order to stabilize the iridium compound solution, any commonly used method can be employed. In particular, an aqueous solution of halogenated hydrogen (e.g., hydrochloric acid, hydrobromic acid) or halogenated alkali (e.g., KCl, NaCl, KBr, NaBr) can be added to the system. Alternatively, other silver halide grains doped with iridium may be used during the preparation of the silver halide grains so that the iridium compound is dissolved in the system.

The amount of iridium used within the silver halide grains of the present invention may usually be within the range of about $1\times10^{-2}$ to $1\times10^{-7}$ mole iridium/mole silver, preferably about $1\times10^{-3}$ to $1\times10^{-6}$ and more preferably about $1\times10^{-4}$ to $1\times10^{-5}$ mole iridium/mole silver.

Copper is employed as a second doping agent in the doped silver halide grains of the invention. The copper can be provided using any of the known copper-containing compounds wherein the copper is in the (+2) state. Examples of such compounds include copper (II) fluoride ($CuF_2$); copper (II) chloride ($CuCl_2$); copper (II) bromide ($CuBr_2$); copper (II) iodide ($CuI_2$); copper (II) acetate ($Cu(OAc)_2$); copper (II) carbonate ($CuCl_3$); copper (II) perchlorate ($CU(ClO_4)_2$); copper (II) sulfate ($CuSO_4$); copper (II) tetrafluoroborate ($Cu(BF_4)_2$), copper (II) trifluoroacetate ($Cu(OCOCF_3)_2$); copper (II) cyanide ($Cu(CN)_2$); copper (II) thiocyanate ($Cu(SCN)_2$); and the like.

The copper dopant agent is generally present in the range of about $1\times10^{-2}$ to $1\times10^{-7}$ moles per mole of silver, preferably about $1\times10^{-3}$ to $1\times10^{-6}$ moles per mole of silver and more preferably about $1\times10^{-4}$ to $1\times10^{-5}$ moles per mole of silver.

Pre-formed doped silver halide emulsions in the element of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

The light sensitive doped silver halide used in the present invention can be employed in a range of 0.005 mole to 0.5 mole and preferably from 0.01 mole to 0.15 mole, per mole of non-photosensitive reducible source of silver. The silver halide may be added to the emulsion layer in any fashion which places it in catalytic proximity to the non-photosensitive reducible source of silver, although the conversion of material to an organic silver soap in the presence of pre-formed silver halide grains is a preferred embodiment of the present invention.

Sensitizers

The silver halide used in the present invention may be chemically and spectrally sensitized in a manner similar to that used to sensitize conventional wet-processed silver halide or state-of-the-art heat-developable photographic materials.

For example, it may be chemically sensitized with a chemical sensitizing agent, such as a compound containing sulfur, selenium, tellurium, etc., or a compound containing gold, platinum, palladium, ruthenium, rhodium, iridium, or combinations thereof, etc., a reducing agent such as a tin halide, etc., or a combination thereof The details of these procedures are described in T. H. James, The Theory of the Photographic Process, Fourth Edition, Chapter 5, pp. 149 to 169. Suitable chemical sensitization procedures are also disclosed in Shepard, U.S. Pat. No. 1,623,499; Waller, U.S. Pat. No. 2,399,083; McVeigh, U.S. Pat. No. 3,297,447; and Dunn, U.S. Pat. No. 3,297,446. It is also particularly effective to chemically sensitize the photosensitive silver halide in the photothermographic emulsion by the decomposition of sulfur containing compounds on or around the surface of the silver halide grains, usually under oxidizing conditions and at elevated temperatures as described in Winslow et al. U.S. patent application Ser. No. 08/841,953 filed Apr. 8, 1997 entitled "Chemical Sensitization of Photothermographic Silver Halide Emulsions."

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful. Cyanine dyes described in U.S. Pat. No. 5,441,866 and in U.S. Pat. No. 5,541,054 are particularly effective.

An appropriate amount of sensitizing dye added is generally about $10^{-10}$ to $10^{-1}$ mole; and preferably, about $10^{-8}$ to $10^{-3}$ moles of dye per mole of silver halide.

Supersensitizers

To get the speed of the photothermographic elements up to maximum levels and further enhance sensitivity, it is often desirable to use supersensitizers. Any supersensitizer can be used which increases the sensitivity. For example, preferred infrared supersensitizers are described in European Laid Open Patent Application No. 0 559 228 A1 and include heteroaromatic mercapto compounds or heteroaromatic disulfide compounds of the formula:

Ar—S—M or

Ar—S—S—Ar wherein M represents a hydrogen atom or an alkali metal atom.

In the above noted supersensitizers, Ar represents a heteroaromatic ring or fused heteroaromatic ring containing one or more of nitrogen, sulfur, oxygen, selenium or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms).

Most preferred supersensitizers are 2-mercaptobenzimidazole, 2-mercapto-5-methylbenzimidazole (I), 2-mercaptobenzothiazole, and 2-mercaptobenzoxazole (MBO).

The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

The Non-Photosensitive Reducible Silver Source

The present invention includes a non-photosensitive reducible silver source. The non-photosensitive reducible silver source that can be used in the present invention can be any compound that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellitate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663. Soluble silver carboxylates having increased solubility in coating solvents and affording coatings with less light scattering can also be used. Such silver carboxylates are described in U.S. Pat. No. 5,491,059.

Silver salts of compounds containing mercapto or thione groups and derivatives thereof can also be used. Preferred examples of these compounds include a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido) benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid, a silver salt of thioamide; a silver salt of 5-carboxylic-1-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

Silver salts of acetylenes can also be used. Silver acetylides are described in U.S. Pat. Nos. 4,761,361 and 4,775,613.

Silver half soaps can also be used. A preferred example of a silver half soap is an equimolar blend of silver behenate and behenic acid, which analyzes for about 14.5% by weight solids of silver in the blend and which is prepared by precipitation from an aqueous solution of the sodium salt of commercial behenic acid.

Transparent sheet elements made on transparent film backing require a transparent coating. For this purpose a silver behenate full soap, containing not more than about 15% of free behenic acid and analyzing about 22% silver, can be used.

The method used for making silver soap emulsions is well known in the art and is disclosed in *Research Disclosure,* April 1983, item 22812, *Research Disclosure,* October 1983, item 23419, and U.S. Pat. No. 3,985,565.

The silver halide and the non-photosensitive reducible silver source that form a starting point of development should be in catalytic proximity (i.e., reactive association). "Catalytic proximity" or "reactive association" means that they should be in the same layer, in adjacent layers, or in layers separated from each other by an intermediate layer having a thickness of less than 1 micrometer (1 $\mu$m). It is preferred that the silver halide and the non-photosensitive reducible silver source be present in the same layer.

The source of reducible silver generally constitutes about 5 to about 70% by weight of the emulsion layer. It is preferably present at a level of about 10 to about 50% by weight of the emulsion layer.

The Reducing Agent for the Non-Photosensitive Reducible Silver Source

The reducing agent for the organic silver salt may be any compound, preferably an organic compound, that can reduce silver ion to metallic silver. Conventional photographic developers such as phenidone, hydroquinones, and catechol are useful, but hindered bisphenol reducing agents are preferred.

A wide range of reducing agents has been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidonehexose reductone; sulfonamidophenol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; ascorbic acid derivatives, such as 1-ascorbylpalmitate, ascorbylstearate; unsaturated aldehydes and ketones; certain 1,3-indanediones, and 3-pyrazolidones (phenidones).

Hindered bisphenol developers are compounds that contain only one hydroxy group on a given phenyl ring and have at least one additional substituent located ortho to the hydroxy group. They differ from traditional photographic developers which contain two hydroxy groups on the same phenyl ring (such as is found in hydroquinones). Hindered phenol developers may contain more than one hydroxy group as long as they are located on different phenyl rings. Hindered phenol developers include, for example, binaphthols (i.e., dihydroxybinaphthyls), biphenols (i.e., dihydroxybiphenyls), bis(hydroxynaphthyl)methanes, bis(hydroxyphenyl)methanes, hindered phenols, and naphthols.

Non-limiting representative bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane. For additional compounds see U.S. Pat. No. 5,262,295 at column 6, lines 12–13, incorporated herein by reference.

Non-limiting representative biphenols include 2,2'-dihydroxy-3,3'-di-t-butyl-5,5-dimethylbiphenyl; 2,2'-dihydroxy-3,3',5,5'-tetra-t-butylbiphenyl; 2,2'-dihydroxy-3,3'-di-t-butyl-5,5'-dichlorobiphenyl; 2-(2-hydroxy-3-t-butyl-5-methylphenyl)-4-methyl-6-n-hexylphenol; 4,4'-dihydroxy-3,3',5,5'-tetrat-butylbiphenyl; and 4,4'-dihydroxy-3,3',5,5'-tetramethylbiphenyl. For additional compounds see U.S. Pat. No. 5,262,295 at column 4, lines 17–47, incorporated herein by reference.

Non-limiting representative bis(hydroxynaphthyl) methanes include 2,2'-methylene-bis(2-methyl-1-naphthol) methane. For additional compounds see U.S. Pat. No. 5,262,295 at column 6, lines 14–16, incorporated herein by reference.

Non-limiting representative bis(hydroxyphenyl)methanes include bis(2-hydroxy-3-t-butyl-5-methylphenyl)methane (CAO-5); 1,1-bis(2-hydroxy-3,5-dimethylphenyl)-3,5,5-trimethylhexane (Permanax™ or Nonox™); 1,1'-bis(3,5-tetra-t-butyl-4-hydroxy)methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane. For additional compounds see U.S. Pat. No. 5,262,295 at column 5 line 63 to column 6, line 8 incorporated herein by reference.

Non-limiting representative hindered phenols include 2,6-di-t-butylphenol; 2,6-di-t-butyl-4-methylphenol; 2,4-di-t-butylphenol; 2,6-dichlorophenol; 2,6-dimethylphenol; and 2-t-butyl-6-methylphenol.

Non-limiting representative hindered naphthols include 1-naphthol; 4-methyl-1-naphthol; 4-methoxy-1-naphthol; 4-chloro-1-naphthol; and 2-methyl-1-naphthol. For additional compounds see U.S. Pat. No. 5,262,295 at column 6, lines 17–20, incorporated herein by reference.

The reducing agent should be present as 1 to 15% by weight of the imaging layer. In multilayer elements, if the reducing agent is added to a layer other than an emulsion layer, slightly higher proportions, of from about 2 to 20%, tend to be more desirable.

Photothermographic elements of the invention may contain contrast enhancers, co-developers or mixtures thereof. For example, the trityl hydrazide or formyl phenylhydrazine compounds described in U.S. Pat. No. 5,496,695 may be used; the amine compounds described in U.S. Pat. No. 5,545,505 may be used; hydroxamic acid compounds described in U.S. Pat. No. 5,545,507 may be used; the acrylonitrile compounds described in U.S. Pat. No. 5,545,515 may be used; the N-acyl-hydrazide compounds as described in U.S. Pat. No. 5,558,983 may be used; the 3-heteroaromatic-substituted acrylonitrile compounds described in U.S. Pat. No. 5,634,339; the hydrogen atom donor compounds described in U.S. Pat. No. 5,637,449; the 2-substituted malondialdehyde compounds described in U.S. patent application Ser. No. 08/615,359 (filed Mar. 14, 1996); and the 4-substituted isoxazole compounds described in U.S. patent application Ser. No. 08/615,928 (filed Mar. 14, 1996) may be used.

Photothermographic elements of the invention may also contain other additives such as shelf-life stabilizers, toners, development accelerators, acutance dyes, post-processing stabilizers or stabilizer precursors, and other image-modifying agents.

The Binder

The photosensitive silver halide, the non-photosensitive reducible source of silver, the reducing agent, and any other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers (e.g., terpolymers), are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90% by weight of the emulsion layer, and more preferably at a level of about 45–85% by weight. Where the proportions and activities of the reducing agent for the non-photosensitive reducible source of silver require a particular developing time arid temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (1 77° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10% by weight of the emulsion layer, preferably about 0.1–10% by weight. Toners are well known compounds in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole); merocyanine dyes such as 3-ethyl-5-[(3-ethyl-2-benzothiazolinylidene)-1-methyl-ethylidene]-2-thio-2,4o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asym-triazines, such as 2,4-dihydroxypyrimidine, 2-hydroxy-4-aminopyrimidine, and azauracil; and tetraazapentalene derivatives, such as 3,6-dimercapto-1,4-diphenyl-1H,4H-2,3a,5,6a-tetraazapentalene and 1,4-di-(o-chlorophenyl)-3,6-dimercapto-1H, 4H-2,3a,5,6a-tetraazapentalene.

The photothermographic elements used in this invention can be further protected against the production of fog and can be further stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination include the thiazolium salts described in U.S. Patent Nos. 2,131,038 and U.S. Pat. No. 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; palladium, platinum and gold salts described in U.S. Pat. Nos. 2,566,263 and 2,597,915; and the 2-(tribromomethylsulfonyl)quinoline compounds described in U.S. Pat. No. 5,460,938. Stabilizer precursor compounds capable of releasing stabilizers upon application of heat during development can also be use in combination with the stabilizers of this invention. Such precursor compounds are described in, for example, U.S. Pat. Nos. 5,158,866, 5,175,081, 5,298,390, and 5,300,420. Nitrogen-containing heterocyclic ring compounds which are further associated with a pair of bromine atoms are described in Skoug, U.S. Pat. No. 5,028,523 incorporated herein by reference.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

Photothermographic elements containing emulsion layers described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056, and 3,206,312 or insoluble inorganic salts such as those described in U.S. Pat. No. 3,428,451.

The photothermographic elements of this invention may also contain electroconductive under-layers to reduce static electricity effects and improve transport through processing equipment. Such layers are described in U.S. Pat. No. 5,310,640.

Photothermographic Constructions

The photothermographic elements of this invention may be constructed of one or more layers on a support. Single layer elements should contain the silver halide, the non-photosensitive, reducible silver source, the reducing agent for the non-photosensitive reducible silver source, the binder as well as optional materials such as toners, acutance dyes, coating aids, and other adjuvants.

Two-layer constructions (often referred to as two-trip constructions because of the coating of two distinct layers on the support) should contain silver halide and non-photosensitive, reducible silver source in one emulsion layer (usually the layer adjacent to the support) and some of the other ingredients in the second layer or both layers. Two layer constructions comprising a single emulsion layer coating containing all the ingredients and a protective topcoat are also envisioned.

Barrier layers, preferably comprising a polymeric material, can also be present in the photothermographic element of the present invention. Polymers for the barrier layer can be selected from natural and synthetic polymers such as gelatin, polyvinyl alcohols, polyacrylic acids, sulfonated polystyrene, and the like. The polymers can optionally be blended with barrier aids such as silica.

Photothermographic emulsions used in this invention can be coated by various coating procedures including wire wound rod coating, dip coating, air knife coating, curtain coating, slide coating, or extrusion coating using hoppers of the type described in U.S. Pat. No. 2,681,294. If desired, two or more layers can be coated simultaneously by the procedures described in U.S. Pat. Nos. 2,761,791; 5,340,613; and British Patent No. 837,095. A typical coating gap for the emulsion layer can be about 10–150 micrometers ($\mu$m), and the layer can be dried in forced air at a temperature of about 20–100° C. It is preferred that the thickness of the layer be selected to provide maximum image densities greater than 0.2, and, more preferably, in the range 0.5 to 4.5, as measured by a MacBeth Color Densitometer Model TD 504.

Photothermographic elements according to the present invention can contain acutance dyes and antihalation dyes. The dyes may be incorporated into the photothermographic emulsion layer as acutance dyes according to known techniques. The dyes may also be incorporated into antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated. Antihalation and acutance dyes useful in the present invention are described in U.S. Pat. Nos. 5,135,842; 5,226,452; 5,314,795, and 5,380,635.

Development conditions will vary, depending on the construction used, but will typically involve heating the photothermographic element in a substantially water-free condition after, or simultaneously with, imagewise exposure at a suitably elevated temperature. Thus, the latent image obtained after exposure can be developed by heating the element at a moderately elevated temperature of, from about 80° C. to about 250° C. (176° F. to 482° F.), preferably from about 100° C. to about 200° C. (212° F. to 392° F.), for a sufficient period of time, generally about 1 second to about 2 minutes. A black-and-white silver image is obtained. Heating may be carried out by the typical heating means such as an oven, a hot plate, an iron, a hot roller, a heat generator using carbon or titanium white, or the like.

If desired, the imaged element may be subjected to a first heating step at a temperature and for a time sufficient to intensify and improve the stability of the latent image but insufficient to produce a visible image and later subjected to a second heating step at a temperature and for a time sufficient to produce the visible image. Such a method and its advantages are described in U.S. Pat. No. 5,279,928.

The Support

Photothermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g., polyethylene terephthalate or polyethylene naphthalate), cellulose acetate film, cellulose ester film, polyvinyl acetal film, polyolefinic film (e.g., polyethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are polyethylene terephthalate and polyethylene naphthalate.

A support with a backside resistive heating layer can also be used photothermographic imaging systems such as shown in U.S. Pat. No. 4,374,921.

Use as a Photomask

The possibility of low absorbance of the photothermographic element in the range of 350–450 nm in non-imaged areas facilitates the use of the photothermographic elements of the present invention in a process where there is a subsequent exposure of an ultraviolet or short wavelength visible radiation sensitive imageable medium. For example, imaging the photothermographic element with coherent radiation and subsequent development affords a visible image. The developed photothermographic element absorbs ultraviolet or short wavelength visible radiation in the areas where there is a visible image and transmits ultraviolet or short wavelength visible radiation where there is no visible image. The developed element may then be used as a mask and placed between an ultraviolet or short wavelength visible radiation energy source and an ultraviolet or short wavelength visible radiation photosensitive imageable medium such as, for example, a photopolymer, diazo compound, or photoresist. This process is particularly useful where the imageable medium comprises a printing plate and the photothermographic element serves as an image-setting film.

Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources, such as Aldrich Chemical Co. (Milwaukee, Wis.). All percentages are by weight unless otherwise indicated. The following additional terms and materials were used.

Acryloid™ A-2 1 is a poly(methyl methacrylate) polymer available from Rohm and Haas, Philadelphia, Pa.

Butvar™ B-79 is a poly(vinyl butyral) resin available from Monsanto Company, St. Louis, Mo.

BZT is benzotriazole.

CAB 171-15S and CAB 381-20 are cellulose acetate butyrate polymers available from Eastman Chemical Co., Kingsport, Tenn.

CBBA is 2-(4-chlorobenzoyl)benzoic acid.

MEK is methyl ethyl ketone (2-butanone).

MeOH is methanol.

MMBI is 5-methyl-2-mercaptobenzimidazole. It is a supersensitizer.

4-MPA is 4-methylphthalic acid.

Nonox™ is 1,1-bis(2-hydroxy-3,5-dimethylphenyl)-3,5,5-trimethyl-hexane [CAS RN=7292-14-0] and is available from St. Jean PhotoChemicals, Inc., Quebec. It is a hindered phenol reducing agent (i.e., a developer) for the non-photosensitive reducible source of silver. It is also known as Permanax™ WSO.

PET is polyethylene terephthalate.

PHZ is phthalazine.

PHP is pyridinium hydrobromide perbromide.

TCPA is tetrachlorophthalic acid.

THDI is Desmodur™ N-3300, a biuretized hexamethylenediisocyanate available from Bayer Chemical Corporation.

Antifoggant 1 (AF-1) is 2-(tribromomethylsulfonyl) quinoline. It is described in U.S. Pat. No 5,460,938 and has the structure shown below.

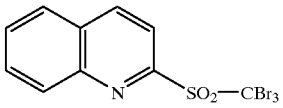

Spectral Sensitizing Dye-1 (SSD-1) is described in U.S. Pat. No. 5,541,054 and has the structure shown below.

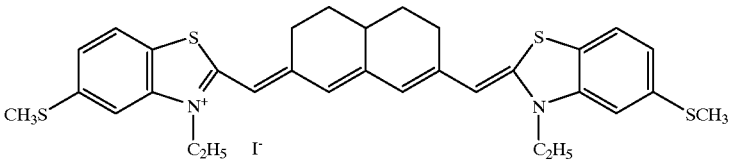

SSD-1

Vinyl Sulfone-1 (VS-1) is described in European Laid Open Patent Application No. 0 600 589 A2 and has structure shown below.

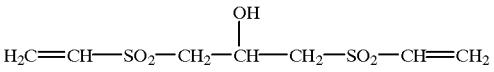

Preparation of Photothermographic Elements:

Four pre-formed iridium-doped core-shell silver halide photothermographic emulsions, A, B, C, D, were prepared by the following procedure. The nature and amounts of dopants are shown in Table 1.

Preparation of Doped Core-Shell Silver Iodobromide Grains: To a first solution (Solution A) having 20 g of phthalated gelatin dissolved in 375 mL of deionized water, held at a temperature between 29–30° C. and pAg of 9.5, were simultaneously added; a second solution (Solution B) containing 27.4 g of potassium bromide and 3.32 g of potassium iodide; and a third solution (Solution C) which was an aqueous solution containing 2.3 mol silver nitrate per liter. The pAg was held at a constant value by means of a pAg feedback control loop as described in *Research Disclosure* No. 17643 and U.S. Pat. Nos. 3,415,650; 3,782,954; and 3,821,002. After a certain percentage of the total delivered silver nitrate was added Solution B was replaced with a doping solution (Solution D) which contained potassium bromide and iridium salt (emulsion samples A and B); or potassium bromide, iridium salt, and copper(II) nitrate (emulsion samples C and D); and Solution C was replaced with Solution E. Alternatively, the iridium and copper(II) solutions can be prepared as separate solutions and added simultaneously with silver and halide solutions.

Thus, samples A and B comprised iridium doped core-shell grains without copper(II) and samples C and D comprised iridium doped core-shell grains also containing $Cu^{2+}$ ion in the shell.

For illustration, the procedure for the preparation of 1 mole of core-shell grain C is shown below.

| Solution A was prepared at 29° C. as follows: | | |
|---|---|---|
| gelatin | 20.0 | g |
| deionized Water | 375.0 | mL |
| 0.1 M KBr | 7.5 | mL |
| adjust to pH = 5.0 with 3N $HNO_3$ | | |
| Solution B was prepared at 25° C. as follows: | | |
| KBr | 27.40 | g |
| KI | 3.32 | g |
| deionized Water | 101.00 | g |
| Solution C was prepared at 25° C. as follows: | | |
| $AgNO_3$ | 42.3 | g |
| deionized Water | 102.5 | g |
| Solutions B and C were jetted into Solution A over 13 minutes. | | |

-continued

| Solution D was prepared at 25° C. as follows: | | |
|---|---|---|
| KBr | 89.300 | g |
| $Cu(NO_3)_2.2.5H_2O$ | 0.002 | g |
| $K_2IrCl_6$ | 0.006 | g |
| deionized Water | 287.000 | g |
| Solution E was prepared at 25° C. as follows: | | |
| $AgNO_3$ | 127.0 | g |
| Deionized Water | 307.5 | g |
| Solutions D and E were jetted into Solution A over 18 minutes. | | |

The core-shell grains were washed with water and then desalted. The average grain size was 0.075 mm as determined by Scanning Electron Microscopy (SEM).

The dopant composition of Solution D for each of these grains is shown in Table 1 below.

TABLE 1

Dopant Composition in Solution D.

| Grain Sample | $K_2IrCl_6$ (mg/mol Ag) | $Cu(NO_3)_2.2.5H_2O$ (mg/mol Ag) |
|---|---|---|
| A | 6 | 0 |
| C (Invention) | 6 | 2 |
| B | 6 | 0 |
| D (Invention) | 6 | 2 |

Preparation of Iridium-Doped Pre-formed Silver Halide/Organic Silver Salt Dispersion: A silver halide/organic silver salt dispersion was prepared for each of the pre-formed silver halide grains prepared above. This material is also referred to as a silver soap dispersion or emulsion.

I. Ingredients

1. Pre-formed silver halide grains prepared above, 0.10 mole at 700 g/mole in 1.25 liter $H_2O$ at 42° C.
2. 88.5 g of NaOH in 1.50 liter $H_2O$
3. 360 g of $AgNO_3$ in 2.5 liter $H_2O$
4. 118 g of Humko Type 9718 fatty acid (available from Witco. Co., Memphis, Tenn.)
5. 570 g of Humko Type 9022 fatty acid (available from Witco. Co., Memphis, Tenn.)
6. 19 mL of conc. $HNO_3$in 50 mL H2O II. Reaction 1. Dissolve ingredients #4 and #5 at 80° C. in 13 liter of $H_2O$ and mix for 15 minutes.
2. Add ingredient #2 to Step 1 at 80° C. and mix for 5 minutes to form a dispersion.
3. Add ingredient #6 to the dispersion at 80° C., cooling the dispersion to 55° C. and stirring for 25 minutes.
4. Add ingredient #1 to the dispersion at 55° C. and mix for 5 minutes.
5. Add ingredient #3 to the dispersion at 55° C. and mix for 10 minutes.
6. Wash until wash water has a resistivity of 20,000 ohm/$cm^2$.
7. Dry at 45° C. for 72 hours.

Homogenization of Pre-formed Soaps (Homogenate): A pre-formed silver fatty acid salt homogenate was prepared by homogenizing each of the pre-formed soaps, prepared above, in organic solvent and Butvar™ B-79 poly(vinyl butyral) according to the following procedure.

1. Add 374 g of pre-formed soap to 1,404 g of 2-butanone and 20 g of Butvar™ B-79.
2. Mix the dispersion for 10 minutes and hold for 24 hours.
3. Homogenize twice at 4000 psi.

Preparation of Photothermographic Emulsions: The pre-formed homogenate (200 g) was held at 70° F. with stirring. A solution of 0.16 g of pyridinium hydrobromide perbromide (PHP) in 2 mL of methanol was added dropwise and the mixture allowed to stir at 70° F. for 1 hour. The addition of 1.00 mL of a calcium bromide solution (1 g of $CaBr_2$ in 10 g of methanol) was followed by stirring for 30 minutes to form a homogenized photothermographic emulsion. The photothermographic emulsion thus obtained contained either iridium doped pre-formed core-shell silver halide crystals or iridium and copper(II) doped pre-formed core-shell silver halide crystals depending on the method of preparation.

To 240 g of the photothermographic emulsion prepared above was added a premixed solution containing the following:

| Material | Amount |
|---|---|
| SSD-1 | 0.006 g |
| MMBI | 0.140 g |
| CBBA | 1.400 g |
| MeOH | 5.000 g |

The photothermographic emulsion was then stirred for 1 hour at 70° F. The mixture was then cooled to 55° F. and 42 g of Butvar™ B-79 was added. After stirring for 30 minutes, the following were than added in 15 minute increments with stirring.

| Material | Amount |
|---|---|
| AF-1 | 1.20 g |
| Nonox ™ | 10.50 g |
| THDI | 0.62 g |
| TCPA | 0.35 g |
| PHZ | 0.95 g |
| 4-MPA | 0.46 g |

A topcoat solution was prepared with the following ingredients:

| Material | Amount |
|---|---|
| 2-Butanone | 92.00 g |
| Acryloid ™ A-21 | 0.29 g |
| CAB 171-15S | 7.50 g |
| VS-1 | 0.15 g |
| BZT | 0.08 g |

Coating of Photothermographic Light Sensitive Material: The photothermographic emulsion and topcoat were coated using a dual knife coater (an apparatus consisting of two hinged knife-coating blades in series) onto the front side of a 7 mil (178 mm) blue tinted poly(ethylene terephthalate) support having an indolenine dye-containing antihalation layer coated on the back side. After raising the hinged knives the support was placed in position on the coater bed. The knives were then lowered and locked into place. The height of the knives was adjusted with wedges controlled by screw knobs and measured with electronic gauges. Knife #1 was raised to a clearance corresponding to the thickness of the support plus the desired coating gap for the emulsion layer (layer #1). Knife #2 was raised to a height equal to the desired thickness of the support plus the desired coating gap for the emulsion layer (layer #1) plus the desired coating gap for the topcoat layer (layer #2).

Aliquots of photothermographic emulsion and topcoat were poured onto the support in front of the corresponding knives. The substrate was immediately drawn past the knives to produce a double layered coating in a single coating operation. The coating gap for the photothermographic emulsion layer was 3.9 mil (99.0 $\mu$m) over the support and 5.2 mil (132 $\mu$m) over the support for the topcoat layer. The dual layer photothermographic element was placed in an oven and dried at 175° F. (79.4° C.) for 5 minutes.

Sensitometric Stability Measurements: The coated and dried photothermographic elements were cut into 1.5 inch by 8 inch strips (3.8 cm×20.3 cm) and exposed with a laser sensitometer incorporating a 810 nm laser diode. After exposure, the film strips were processed by heating at 255° F. (123.9° C.) for 15 seconds to give an image.

The images obtained were evaluated on custom built computer scanned densitometers using a filter appropriate to the sensitivity of the photothermographic element (when required) and are believed to be comparable to measurements from commercially available densitometers. Sensitometric results include $D_{min}$, D-Hi, Speed-2, and Contrast-1.

$D_{min}$ is the density of the non-exposed areas after development. It is the average of eight lowest density values on the exposed side of the fiducial mark.

$D_{hi}$ is the density corresponding to an exposure at 1.40 log E above the exposure corresponding to a density of 0.20 above $D_{min}$.

Speed-2 is Log (1/E)+4 (where E is the exposure in ergs/cm$^2$) needed to a achieve a density of 1.00 above $D_{min}$.

Average Contrast-1 (AC-1) is the slope of the line joining the density points of 0.60 and 2.00 above $D_{min}$.

Example 1

The sensitometry of the photothermographic elements prepared above were determined after I day, and after storage at 70° F. and 50% relative humidity for 3, 6, 9, and 15 months. The results, shown below, demonstrate that under normal shelf-aging conditions, incorporation of $Cu^{2+}$ into pre-formed iridium doped silver halide grains in photothermographic emulsions gives better shelf stability than silver halide grains doped only with iridium. In the example below, % Delta is defined as:

$$\%\ \text{Delta} = \frac{\text{sensitometry value after 1 day} - \text{sensitometry value after 15 months}}{\text{sensitometry value after 1 day}} \times 100$$

| Sample | | Age | $D_{min}$ | $D_{hi}$ | Speed-2 | AC-1 |
|---|---|---|---|---|---|---|
| A | (Control) $Ir^{4+}$ only | 1 Day | 0.195 | 4.238 | 1.847 | 6.281 |
| | | 6 Months | 0.215 | 4.029 | 1.786 | 5.271 |
| | | 9 Months | 0.201 | 4.217 | 1.759 | 5.341 |
| | | 15 Months | 0.210 | 4.031 | 1.640 | 4.812 |
| | | % Delta | +7.7% | −4.9% | −11.2% | −23.4% |
| C | (Invention) $Cu^{2+}$ + $Ir^{4+}$ | 1 Day | 0.207 | 4.142 | 1.863 | 5.990 |
| | | 6 Months | 0.209 | 3.967 | 1.865 | 5.703 |
| | | 9 Months | 0.209 | 4.045 | 1.846 | 5.544 |
| | | 15 Months | 0.184 | 4.092 | 1.805 | 5.528 |
| | | % Delta | −11.1% | −1.2% | −3.1% | −7.7% |

Example 2

Accelerated aging studies are a very good method of determining the degree of thermal fog that might result from natural storage and aging. Unexposed strips, prepared above, were aged in ovens maintained at 120° F./50% relative humidity (% RH). After 14 days, the samples were removed, exposed, processed in a manner similar to the freshly coated samples, and compared with samples aged for 1 day.

The results, shown below, demonstrate that under accelerated aging conditions, incorporation of $Cu^{2+}$ into preformed iridium doped silver halide grains of photothermographic emulsions gives better shelf stability than silver halide grains doped only with iridium. In the example below, % Delta is defined as:

$$\%\ \text{Delta} = \frac{\text{sensitometry value after 1 day} - \text{sensitometry value after 14 days}}{\text{sensitometry value after 1 day}} \times 100$$

| Sample | | Age | $D_{min}$ | $D_{hi}$ | Speed-2 | AC-1 |
|---|---|---|---|---|---|---|
| B | (Control) $Ir^{4+}$ only | 1 Day | 0.191 | 4.047 | 1.922 | 6.011 |
| | | 14 Days | 0.197 | 3.893 | 1.693 | 4.636 |
| | | % Delta | +3.1% | −3.8% | −11.9% | −22.9% |
| D | (Invention) $Ir^{4+}$ + $Cu^{2+}$ | 1 Day | 0.212 | 4.081 | 1.997 | 5.547 |
| | | 14 Days | 0.171 | 4.183 | 1.818 | 4.847 |
| | | % Delta | −19.3% | +2.5% | −9.0% | −12.6% |

Example 3

This example demonstrates the importance of the doping site for the $Cu^{2+}$ ions. Photothermographic emulsions were prepared employing iridium doped core-shell silver halide grains prepared for photothermographic emulsion A above. However, in these samples, $Cu^{2+}$ was incorporated into the non-light sensitive silver carboxylate soaps rather than into the light-sensitive silver halide grains. Samples were coated, dried, and imaged in a manner identical to those of Examples 1 and 2 above.

The results, shown below, demonstrate that incorporation of $Cu^{2+}$ into the silver carboxylate soap does not provide the same benefit in sensitometric properties and shelf-life stability.

| Sample | | Age | $D_{min}$ | $D_{hi}$ | Speed-2 | AC-1 |
|---|---|---|---|---|---|---|
| E | 2 mg $Cu^{2+}$/mol silver in silver halide grains | 1 Day | 0.212 | 4.081 | 1.997 | 5.547 |
| | | 2 Months | 0.198 | 4.076 | 1.985 | 5.937 |
| F | 2.3 mg $Cu^{2+}$/mol silver in silver carboxylate soap | 1 Day | 0.246 | 3.251 | 1.844 | 3.405 |
| | | 2 Months | 0.302 | 3.067 | 1.782 | 2.488 |

Reasonable modifications and variations are possible from the foregoing disclosure without departing from either the spirit or scope of the present invention as defined by the claims.

I claim:

1. A negative-acting photothermographic element comprising a support bearing at least one heat-developable, photosensitive, image-forming photothermographic emulsion layer comprising:

(a) pre-formed photosensitive silver halide grains that are doped with a first doping agent that is a water-soluble iridium compound, and a second doping agent that is a copper (II) containing compound;

(b) a non-photosensitive, reducible source of silver;

(c) a reducing agent for the non-photosensitive, reducible source of silver; and (d) a binder.

2. The element of claim 1 wherein the element substantially retains its sensitometry characteristics after 15 months under normal storage conditions.

3. The element of claim 1 wherein the average contrast-1 value of the element changes by 10% or less after 15 months under normal storage conditions.

4. The element of claim 1 wherein the copper doping agent is present in an amount of about 1 to 100 ppm.

5. The element of claim 1 wherein the iridium is present in an amount of about 1 to 100 ppm.

6. The element of claim 1 wherein the silver halide grains are core-shell grains.

7. The element of claim 1 wherein the non-photosensitive, reducible silver source is a silver salt of an aliphatic carboxylic acid having from 10 to 30 carbon atoms.

8. The element of claim 1 wherein the non-photosensitive, reducible silver source is silver behenate.

9. The element of claim 1 wherein the silver halide grains have an average diameter of less than about 0.1 μm.

10. The element of claim 1 wherein the silver halide grains have an average diameter of about 0.02 to 0.08 μm.

11. The element of claim 1 wherein said water-soluble iridium compound is a halogenated iridium (III) compound, a halogenated (IV) compound or an iridium complex salt comprising a halogen, amine or oxalate ligand.

12. The element of claim 1 wherein said copper (II) containing compound is copper fluoride, copper chloride, copper bromide, copper iodide, copper acetate, copper carbonate, copper perchlorate, copper sulfate, copper tetrafluoroborate, copper trifluoroacetate, copper cyanide or copper thiocyanate.

13. A negative-acting photothermographic element comprising a support bearing at least one heat-developable, photosensitive, image-forming photothermographic emulsion layer comprising:

(a) pre-formed photosensitive silver halide grains that are doped with a first doping agent that is a water-soluble iridium compound and a second doping agent that is a copper (II) containing compound;

(b) a non-photosensitive, reducible source of silver;

(c) a reducing agent for the non-photosensitive, reducible source of silver; and (d) a binder;

wherein the element substantially retains its sensitometric characteristics after about 15 months under normal storage conditions.

14. The element of claim 13 wherein the sensitometry characteristics comprise an average contrast-1 value which changes by 10% or less after 15 months under normal storage conditions.

15. The element of claim 13 wherein the copper doping agent is present in an amount of about $1\times10^{-2}$ moles per mole of silver to about $1\times10^{-7}$ moles per mole of silver.

16. The element of claim 13 wherein the iridium is present in an amount of about $1\times10^{-2}$ moles per mole of silver to about $1\times10^{-7}$ moles per mole of silver.

17. The element of claim 13 wherein the non-photosensitive, reducible silver source is a silver salt of an aliphatic carboxylic acid having from 10 to 30 carbon atoms.

18. The element of claim 13 wherein the non-photosensitive, reducible silver source is silver behenate.

19. The element of claim 13 wherein the silver halide grains have an average diameter of less than about 0.1 μm.

20. The element of claim 13 wherein the silver halide grains have an average diameter of about 0.02 to about 0.08 μm.

21. The element of claim 13 wherein the non-photosensitive, reducible silver source is a mixture of silver salts of an aliphatic carboxylic acid having from 10 to 30 carbon atoms.

22. A negative-acting photothermographic element comprising a support bearing at least one heat-developable, photosensitive, image-forming photothermographic emulsion layer comprising:

(a) pre-formed photosensitive silver halide grains that are doped with a first doping agent that is a water-soluble iridium compound, and a second doping agent that is a copper (II) containing compound;

(b) a non-photosensitive, reducible source of silver;

(c) a reducing agent for the non-photosensitive, reducible source of silver; and (d) a binder;

wherein the element substantially retains its sensitometric characteristics after about 9 months under normal storage conditions.

23. The element of claim 22 wherein the sensitometry characteristics comprise an average contrast-1 value which changes by 10% or less after 9 months under normal storage conditions.

24. A negative-acting photothermographic element comprising a support bearing at least one heat-developable, photosensitive, image-forming photothermographic emulsion layer comprising:

(a) pre-formed photosensitive silver halide grains that are doped with a first doping agent that is a water-soluble iridium compound, and a second doping agent that is a copper (II) containing compound;

(b) a non-photosensitive, reducible source of silver;

(c) a reducing agent for the non-photosensitive, reducible source of silver; and (d) a binder;

wherein the element substantially retains its sensitometric characteristics after about 6 months under normal storage conditions.

25. The element of claim 24 wherein the sensitometry characteristics comprise an average contrast-1 value which changes by 10% or less after 6 months under normal storage conditions.

26. A negative-acting photothermographic element comprising a support bearing at least one heat-developable, photosensitive, image-forming photothermographic emulsion layer comprising:

(a) pre-formed photosensitive silver halide core-shell grains that are doped with a first doping agent that is a water-soluble iridium compound, and a second doping agent that is a copper (II) containing compound;

(b) a non-photosensitive, reducible source of silver;

(c) a reducing agent for the non-photosensitive, reducible source of silver; and (d) a binder;

wherein the element substantially retains its sensitometric characteristics after about 9 months under normal storage conditions.

27. A negative-acting photothermographic element comprising a support bearing at least one heat-developable, photosensitive, image-forming photothermographic emulsion layer comprising:

(a) pre-formed photosensitive silver halide core-shell grains that are doped with a first doping agent that is a water-soluble iridium compound, and a second doping agent that is a copper (II) containing compound;

(b) a non-photosensitive, reducible source of silver;

(c) a reducing agent for the non-photosensitive, reducible source of silver; and (d) a binder;

wherein the element substantially retains its sensitometric characteristics after about 6 months under normal storage conditions.

* * * * *